United States Patent [19]

Svensson

[11] Patent Number: 4,630,413

[45] Date of Patent: Dec. 23, 1986

[54] POST FOR TRAFFIC SIGNS, LIGHTING AND THE LIKE

[76] Inventor: Lars Svensson, Vikingavägen 112, Vallentuna S-186 00, Sweden

[21] Appl. No.: 684,923

[22] PCT Filed: Mar. 21, 1984

[86] PCT No.: PCT/SE84/00101

§ 371 Date: Dec. 4, 1984

§ 102(e) Date: Dec. 4, 1984

[87] PCT Pub. No.: WO84/04117

PCT Pub. Date: Oct. 25, 1984

[30] Foreign Application Priority Data

Apr. 8, 1983 [SE] Sweden ..... 8301967

[51] Int. Cl.[4] ..... E01F 9/01

[52] U.S. Cl. ..... 52/98; 52/40; 404/10

[58] Field of Search ..... 52/38, 40, 98, 731; 404/6, 9, 10; 40/607, 610; D25/77

[56] References Cited

U.S. PATENT DOCUMENTS

| | | | |
|---|---|---|---|
| 4,061,435 | 12/1977 | Schmanski et al. | 404/10 |
| 4,196,550 | 4/1980 | Svensson | 52/98 |
| 4,236,843 | 12/1980 | Chisholm | 52/98 X |
| 4,378,175 | 3/1983 | Hasselqvist et al. | 40/607 X |

FOREIGN PATENT DOCUMENTS 275331 8/1951 Switzerland .

*Primary Examiner*—William F. Pate, III
*Assistant Examiner*—Jean M. LaKemper
*Attorney, Agent, or Firm*—Browdy and Neimark

[57] ABSTRACT

A post, for traffic signs, lighting and the like has a polygonal shape, with essentially rigid sides. The sides situated at right angles to oncoming traffic have attentuated portions therealong. When an oncoming vehicle strikes the post, the attentuated portions break, greatly reducing the strength of the remaining sides.

10 Claims, 6 Drawing Figures

POST FOR TRAFFIC SIGNS, LIGHTING AND THE LIKE

BACKGROUND OF THE INVENTION (a) Field of the Invention

The present invention relates to a post, primarily intended for traffic signs and lighting and the like and of such construction as to offer little resistance when struck by a vehicle.

It is previously known to manufacture posts for the above purpose, the construction of which is such that the posts under normal conditions, like a conventional tube pole, carry the sign and have resistivity to transient load, i.e. essentially wind load, but will yield when subjected to transverse load over a predetermined magnitude.

(b) Description of the Prior Art

A common type of prior art posts with reduced resistance to impacts has a fracture indication in the region where the post is anchored to the foundation. When such a post with sign is being run into it is forced into rotation about its centre of rotation without any translation velocity worth mentioning having been produced, with the consequence that there is a great risk that the post and sign will smash down the car wind-shield at a high relative velocity.

SUMMARY OF THE INVENTION

The essential characteristic of the post according to the invention is that the post consists of a polygonal hollow profile of metal in which each of the sides is relatively rigid in the transverse sense and joined with adjacent sides by portions which are weakened by attenuation of material.

An embodiment of a post in accordance with the invention will be described more fully below with reference to the accompanying drawings, in which:

In the preferred embodiment according to the invention the post consists of a hexagonal hollow profile of extruded metal, preferably light metal. Also other shapes than hexagonal ones may be used. The essential point is that two side portions on either side make such an angle with one another that they will buckle together when the post is run into.

DESCRIPTION OF THE PREFERRED EMBODIMENT

In the preferred embodiment there are two sides 1 and 2 which are localized at right angles to the direction of travel of any striking vehicle and these two sides are joined with one another by two pairs of outwardly inclined sides 3*a*, 4*a* and 3*b*, 4*b* respectively.

All the sides are joined with each other via weakened corner or edge portions formed of internal grooves 5 and 6.

Figure 4:
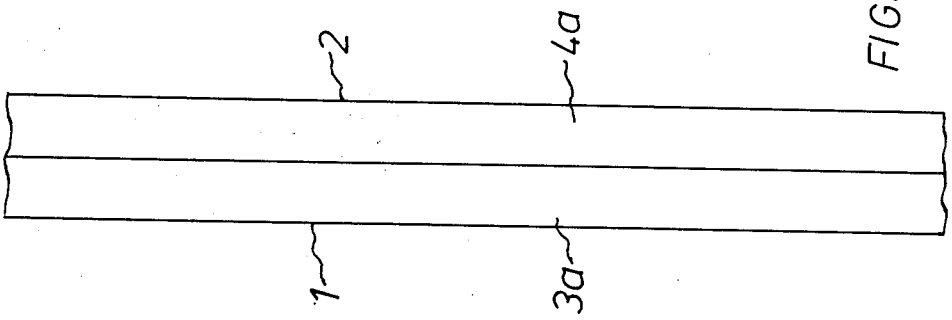
FIG. 4 is a side view of a portion of the post having the cross-section indicated in FIG. 1.

When it is desired to have a more stable post for carrying a large sign it is possible, in order to permit interconnection of several posts in cooperation, to provide the two first-mentioned sides 1 and 2 with a notch 7 and a tenon 8 to guide posts which are joined together by wrapping bands, glueing or by some other appropriate means. An additional post is indicated by dashed lines in FIG. 4.

As long as the post is intact the interconnected sides coact in a normal manner.

When, on the contrary, the post is run into it will be deformed in the way shown in FIGS. 2–3 and 5–6 respectively.

When the side 1 is hit by the bumper of a car it will be pressed in towards the side 2 because the connections at the grooves 5 and 6 are weaker than the remaining material and this will lead to displacement and turning of the sides 3*a*, 4*a* and 3*b*, 4*b* while the material at the grooves 5 and 6 is subjected to a very strong relative tensional strain which rapidly results in a fracture which, in case the grooves have been made by cold rolling or pressing, is brittle and instantaneously progressive. As the cross-sectional extent of the post, as seen in the direction of travel, will rapidly diminish, the section modulus or bending resistance of the post will immediately be reduced. The section modulus of the post in intact condition is dependent on the coaction of the six sides which are kept in rigid relation in certain relative positions.

The cross-sectional reduction of the hollow profile and the ruptures in the corners, which is a consequence of the compression of the sides, involves that the remaining section modulus will substantially be the intrinsic resistance of the compressed material, which, as compared to the initial section modulus, is practically negligible.

Figure 2:
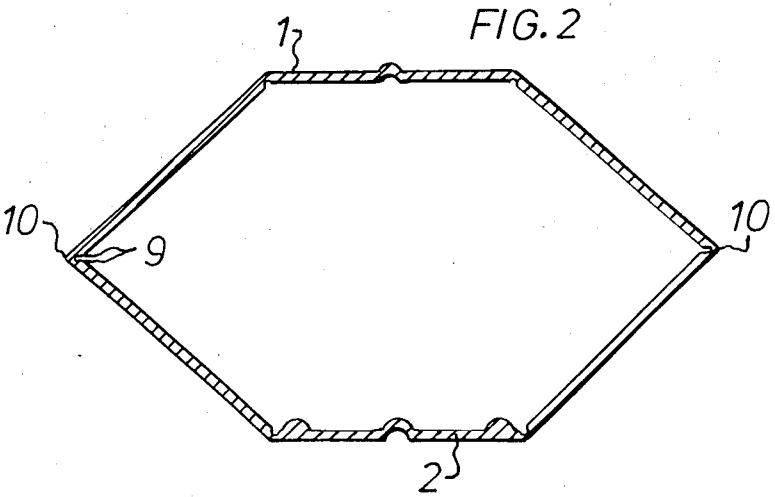
FIGS. 2 and 3 are cross-sections of a post along a plane on level with the point of impact in two successive moments.
Figure 3:
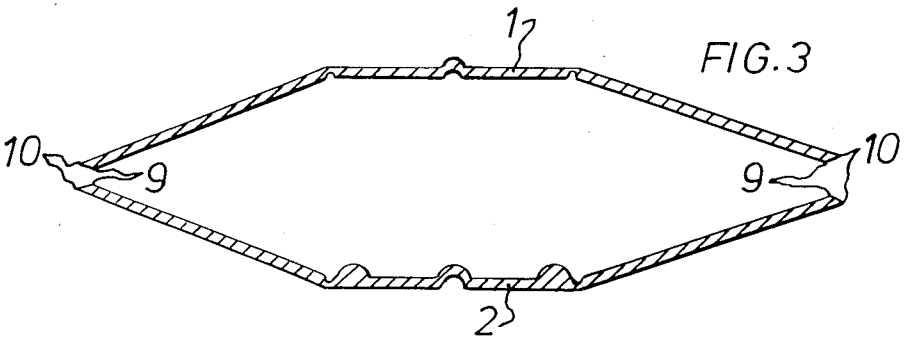
Figure 1:
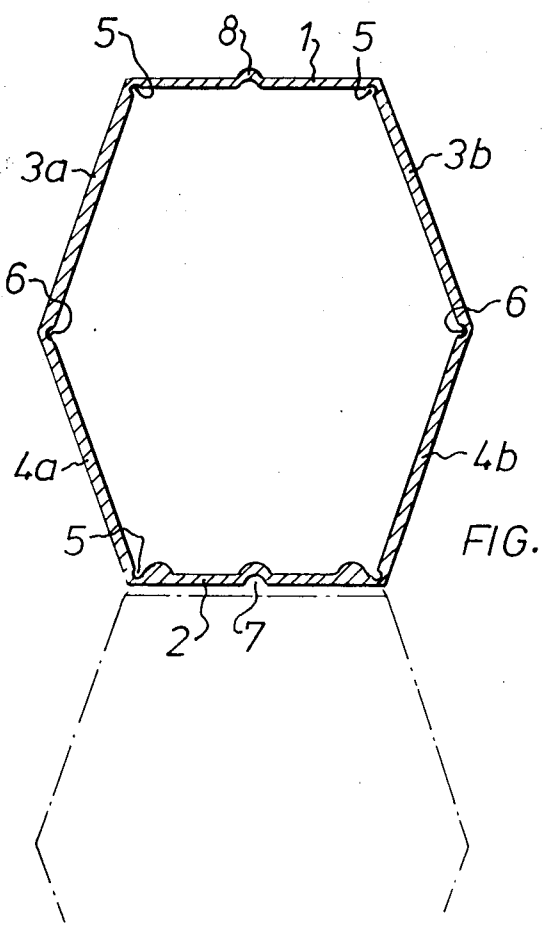
FIG. 1 is a cross-section through a post according to the invention.
Figure 6:
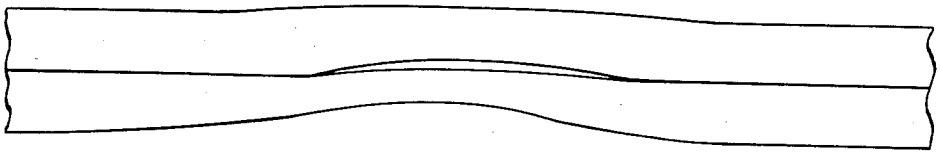
FIGS. 5 and 6 show the same portions after they have been struck by a vehicle and been deformed as indicated in FIGS. 2 and 3.
Figure 5:
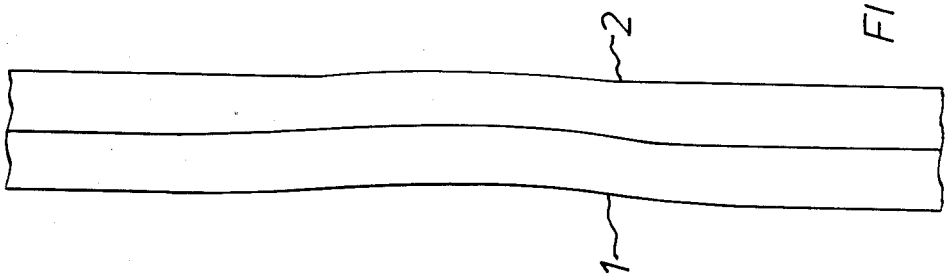

When the two sides 1 and 2 of the hollow profile have been compressed to the position shown in FIGS. 3 and 6 the edges 9 of the grooves 6 situated between the sides 3*a*–4*a* and 3*b*–4*b* respectively will bear against each other, which during continued compression will result in the groove bottom 10 being split up due to the leverage action caused thereby. In this connection the post profile will be divided up, at and outside the struck portion, into two separate strips of material of reduced rigidity.

In case the lower end of the post is firmly anchored in the ground the progressive compression and the splitting of the post will proceed accordingly as the car moves beyond the foundation of the post.

In order that the properties of the posts of the type herein referred to should show to advantage they should be combined with signs of light-weight and yieldable construction.

The post according to the invention may be produced by extrusion of a hollow profile, the material being light metal. Extruded profiles have equal cross-section throughout their length and posts made up of such profiles are most appropriate where the post height is low or the post is partly concealed by e.g. a sign, reference board or the like.

Separate posts of greater height, e.g. lamp posts, are likely to give an unnecessarily clumsy impression if they are of a uniform thickness and for this reason it is desired that such posts taper in upward direction. As for posts of upwardly tapering cross-section, instead of using extruded profiles use is made of plastic-coated steel sheet which is provided with longitudinal weakening lines, converging towards the intended tapered end, in the form of pressed or stamped grooves or the like where the material is thinner than the remaining sheet. The sheet is folded up after stamping of the grooves and jointed or lapped together so as to constitute a closed polygonal tube. Irrespective of whether the post is made of extruded light metal or stamped steel sheet it will function as described above when being run into. However, in case of cold-worked grooves the longitudinal fracture will become brittle and progress also in the non-deformed section.

The invention must not be considered restricted to that described above and shown in the drawings but may be modified in various ways within the scope of the appended claims.

I claim:

1. A post deformable upon impact and offering little resistance when struck by a vehicle, the post comprising a plurality of essentially rigid metal sides (1–4) joined to form a polygonal hollow profile by attenuated folding means comprising thinned and weakened connecting portions (6), the angle formed between each adjacent side being obtuse; the weakened portions being formed of inside grooves (6) having two edges (9) and a groove bottom (10), made in the transition between the sides (1–4); the grooves (6) being shaped and dimensioned such that, when the sides interconnected by such a grooved connective portion are bent up beyond a certain angle upon impact, the edges (9) of the groove will come into engagement with one another and the attenuated material at the groove bottom (10) will tear.

2. Post as claimed in claim 1, characterized in that the hollow profile is hexagonal with the sides being pairwise generally parallel, and two sides (1 and 2), adapted to be oriented at right angles to the direction of travel of a striking vehicle, are shorter than the other sides and situated at a greater distance from each other.

3. Post as claimed in claim 2, wherein said hollow profile has two opposing and parallel sides which are provided with means (7, 8) for positioning additional hollow profiles.

4. The post of claim 3 wherein said post is constructed of an extruded light metal and said hollow profile comprises a hexagon, and means for splitting of said attenuated portions upon compression of said parallel sides toward each other whereby leverage is exerted upon said attenuated portions (6) to result in the splitting of said attenuated portions.

5. Post as claimed in claim 1, wherein the post comprises an extruded hollow profile of light metal.

6. Post as claimed in claim 1, wherein the post comprises steel sheet bent up to form a closed profile which, before bending, has been provided with longitudinal grooves in which the material is thinner than in the remaining steel of said profile.

7. Post as claimed in claim 6, wherein the grooves in the post material have been shaped by cold pressing or cold rolling resulting in embrittlement of the material in the grooves.

8. A support post deformable and collapsible upon impact by a motor vehicle, comprising a plurality of essentially rigid generally planar metal sides joined along edges thereof to form a polygonal hollow profile;

folding means along the edges of said sides to provide folding, deformation and collapsing of said post along said edges upon impact by a motor vehicle, said folding means comprising connecting portions along said edges; and means for effecting tearing along at least some of said connecting portions when subjected to extended deformation beyond a selected angle upon impact by a motor vehicle, said means comprising a groove (6) defining a thinned and weakened line along each said at least some connecting portions, said groove having two edges (9) and a groove bottom (10), the edges (9) of the groove coming into contact with one another upon said extended deformation and causing the groove bottom (10) to tear.

9. A support post according to claim 8 wherein said weakened connecting portions are brittle.

10. A support post according to claim 8 wherein said at least some of said connecting portions define obtuse angles between adjacent side walls.

* * * * *